US010058922B2

(12) United States Patent
Shinohara et al.

(10) Patent No.: US 10,058,922 B2
(45) Date of Patent: Aug. 28, 2018

(54) COMPACT FOR PRODUCING A SINTERED ALLOY, A WEAR-RESISTANT IRON-BASED SINTERED ALLOY, AND A METHOD FOR PRODUCING THE SAME

(71) Applicants: TOYOTA JIDOSHA KABUSHIKI KAISHA, Toyota-shi, Aichi (JP); FINE SINTER CO., LTD., Kasugai-shi, Aichi (JP); SANYO SPECIAL STEEL CO., LTD., Himeji-shi, Hyogo (JP)

(72) Inventors: Nobuyuki Shinohara, Tajimi (JP); Kimihiko Andou, Toyota (JP); Yoshihisa Ueda, Kasugai (JP); Yusaku Yoshida, Tajimi (JP); Masaru Sugimoto, Tajimi (JP); Toshiyuki Sawada, Himeji (JP); Shingo Fukumoto, Himeji (JP)

(73) Assignees: TOYOTA JIDOSHA KABUSHIKI KAISHA, Toyota-shi, Aichi (JP); FINE SINTER CO., LTD, Kasugai-shi, Aichi (JP); SANYO SPECIAL STEEL CO., LTD, Himeji-shi, Hyogo (JP)

( * ) Notice: Subject to any disclaimer, the term of this patent is extended or adjusted under 35 U.S.C. 154(b) by 329 days.

(21) Appl. No.: 14/814,694

(22) Filed: Jul. 31, 2015

(65) Prior Publication Data

US 2016/0052059 A1 Feb. 25, 2016

(30) Foreign Application Priority Data

Aug. 22, 2014 (JP) ..... 2014-169423

(51) Int. Cl.
*B22F 3/12* (2006.01)
*C22C 33/02* (2006.01)
(Continued)

(52) U.S. Cl.
CPC ..... *B22F 3/12* (2013.01); *C22C 33/0207* (2013.01); *C22C 33/0257* (2013.01);
(Continued)

(58) Field of Classification Search
CPC ..... B22F 3/12
See application file for complete search history.

(56) References Cited

U.S. PATENT DOCUMENTS 4,332,616 A 6/1982 Morishita et al.
5,858,056 A 1/1999 Fujine et al.
(Continued)

FOREIGN PATENT DOCUMENTS

EP 0 010 545 A1 5/1980
EP 0 339 436 A1 11/1989
(Continued)

OTHER PUBLICATIONS

Communication dated Dec. 6, 2001, issued by the United States Patent and Trademark Office in U.S. Appl. No. 09/734,926.
(Continued)

*Primary Examiner* — Colleen P Dunn
*Assistant Examiner* — Rajinder Bajwa
(74) *Attorney, Agent, or Firm* — Sughrue Mion, PLLC

(57) ABSTRACT

The object of the present invention is to provide a compact for producing a sintered alloy which allows a sintered alloy obtained by sintering the compact to have improved mechanical strength and wear resistance, a wear-resistant iron-based sintered alloy, and a method for producing the same. The wear-resistant iron-based sintered alloy is produced by: forming a compact for producing a sintered alloy from a powder mixture containing a hard powder, a graphite powder, and an iron-based powder by powder compacting; and sintering the compact for producing a sintered alloy while diffusing C in the graphite powder of the compact for
(Continued)

producing a sintered alloy in hard particles that constitute the hard powder. The hard particles contain 10% to 50% by mass of Mo, 3% to 20% by mass of Cr, and 2% to 15% by mass of Mn, with the balance made up of incidental impurities and Fe, and the hard powder and the graphite powder contained in the powder mixture account for 5% to 60% by mass and 0.5% to 2.0% by mass of the total amount of the hard powder, the graphite powder, and the iron-based powder, respectively.

3 Claims, 4 Drawing Sheets

(51) Int. Cl.

| | |
|---|---|
| ***C22C 38/04*** | (2006.01) |
| ***C22C 38/22*** | (2006.01) |
| ***C22C 38/36*** | (2006.01) |
| ***C22C 38/38*** | (2006.01) |

(52) U.S. Cl.
CPC ..... *C22C 38/04* (2013.01); *C22C 38/22* (2013.01); *C22C 38/36* (2013.01); *C22C 38/38* (2013.01); *B22F 2998/10* (2013.01)

(56) References Cited

U.S. PATENT DOCUMENTS

| | | | | |
|---|---|---|---|---|
| 5,859,376 | A | 1/1999 | Ishibashi et al. | |
| 6,613,120 | B2 * | 9/2003 | Ando et al. | 75/246 |
| 2001/0018852 | A1 | 9/2001 | Ando et al. | |
| 2006/0219054 | A1 | 10/2006 | Kawata et al. | |

FOREIGN PATENT DOCUMENTS

| | | | |
|---|---|---|---|
| EP | 1108800 | A2 | 6/2001 |
| GB | 1 269 407 | A | 4/1972 |
| GB | 1 504 547 | | 3/1978 |
| GB | 2 334 725 | A | 9/1999 |
| GB | 2 440 737 | A | 2/2008 |
| JP | S53-112206 | A | 9/1978 |
| JP | H04-157138 | A | 5/1992 |
| JP | H06-92627 | B2 | 11/1994 |
| JP | H09-3135 | A | 1/1997 |
| JP | H09-242516 | A | 9/1997 |
| JP | 2716575 | B2 | 2/1998 |
| JP | 2970670 | B1 | 11/1999 |
| JP | 2001-181807 | A | 7/2001 |
| JP | 2006-307331 | A | 11/2006 |
| JP | 2014-98189 | A | 5/2014 |
| JP | 5637201 | B2 | 12/2014 |
| WO | 2014/076530 | A2 | 5/2014 |

OTHER PUBLICATIONS

Communication dated Aug. 13, 2002, issued by the United States Patent and Trademark Office in U.S. Appl. No. 09/734,926.

* cited by examiner

COMPACT FOR PRODUCING A SINTERED ALLOY, A WEAR-RESISTANT IRON-BASED SINTERED ALLOY, AND A METHOD FOR PRODUCING THE SAME

BACKGROUND

Technical Field

The present invention relates to a compact for producing a sintered alloy containing hard particles which are preferable for improving mechanical strength and wear resistance of a sintered alloy, a wear-resistant iron-based sintered alloy obtained by sintering the compact, and a method for producing the same.

Background Art

Conventionally, a sintered alloy including an iron-based substrate is used for a valve sheet or the like in some cases. Hard particles can be added to a sintered alloy to further improve wear resistance. In general, when hard particles are added, a hard powder including hard particles is mixed with a powder having a composition of a low-alloy steel or stainless steel. The obtained powder mixture is formed into a compact for producing a sintered alloy by powder compacting. Then, the compact for producing a sintered alloy is sintered to obtain a sintered alloy.

As a method for producing such sintered alloy, a method for producing a wear-resistant iron-based sintered alloy, which includes: forming a compact for producing a sintered alloy from a powder mixture containing a hard powder, a graphite powder, and an iron-based powder by powder compacting; and sintering the compact for producing a sintered alloy while diffusing C in the graphite powder of the compact for producing a sintered alloy in hard particles that constitute the hard powder has been suggested (see, e.g., Patent Document 1). The hard particles that constitute a hard powder contain 20% to 60% by mass of Mo and 3% to 15% by mass of Mn, with the balance made up of incidental impurities and Fe. The hard powder and the graphite powder contained in the powder mixture account for 15% to 60% by mass and 0.2 to 2% by mass of the total amount of the hard powder, the graphite powder, and the iron-based powder, respectively. According to the above production method, the amount of carbon contained in hard particles is limited, thereby making it possible to improve wear resistance of a sintered alloy obtained by sintering a compact while increasing formability of the compact before sintering.

RELATED ART DOCUMENTS

Patent Documents

Patent Document 1: JP 2014-98189 A

SUMMARY

However, as is apparent from the results of experiments conducted by the present inventors described below, mechanical strength and wear resistance of a wear-resistant iron-based sintered alloy produced by the production method disclosed in Patent Document 1 cannot be satisfactory.

Specifically, Patent Document 1 discloses that Mn is added to hard particles to diffuse Mn added to the hard particles in an iron-based substrate upon sintering, thereby securing adhesiveness between the hard particles and the iron-based substrate. However, Mo added to hard particles are not sufficiently diffused in the iron-based substrate upon sintering. Therefore, adhesiveness between the hard particles and the iron-based substrate cannot be sufficiently secured with the addition of Mn alone. As a result, mechanical strength and wear resistance of a sintered alloy cannot be satisfactory.

In addition, the addition of Mo to hard particles causes formation of oxidized Mo (Mo oxide film) on the surface of a sintered alloy so that oxidized Mo functions as a solid lubricant. Although such Mo oxide film is effective against adhesion wear, it is not effective against abrasive wear. Thus, wear resistance is insufficient in this case of wear.

The present invention has been made in consideration of the above problems. The object of the present invention is to provide a compact for producing a sintered alloy which allows a sintered alloy obtained by sintering the compact to have improved mechanical strength and wear resistance based on the premise that formability into a compact before sintering is increased, a wear-resistant iron-based sintered alloy, and a method for producing the same.

As a result of intensive studies to achieve the above object, the present inventors focused on Cr as an element to be added to hard particles. The present inventors had an idea that it would be possible to increase adhesiveness between hard particles and an iron-based substrate so as to improve mechanical strength of a sintered alloy because Cr can be easily diffused in an iron-based substrate with a degree of diffusion that is approximately 6.3 times that of Mo. Further, Cr reacts with C in a graphite powder upon sintering to form Cr carbide. The present inventors therefore considered that wear resistance of a sintered alloy against abrasive wear can be improved.

The present invention has been completed based on the above. The method for producing a wear-resistant iron-based sintered alloy of the present invention is a method for producing a wear-resistant iron-based sintered alloy, which includes the steps of: forming a compact for producing a sintered alloy from a powder mixture containing a hard powder, a graphite powder, and an iron-based powder by powder compacting; and sintering the compact for producing a sintered alloy while diffusing C in the graphite powder of the compact for producing a sintered alloy in hard particles that constitute the hard powder, wherein the hard particles contain 10% to 50% by mass of Mo, 3% to 20% by mass of Cr, and 2% to 15% by mass of Mn, with the balance made up of incidental impurities and Fe, and the hard powder and the graphite powder contained in the powder mixture account for 5% to 60% by mass and 0.2% to 2.0% by mass of the total amount of the hard powder, the graphite powder, and the iron-based powder, respectively.

In addition, the compact for producing a sintered alloy of the present invention is a compact for producing a sintered alloy, which is formed with a powder mixture containing a hard powder, a graphite powder, and an iron-based powder by powder compacting, wherein hard particles that constitute the hard powder contain 10% to 50% by mass of Mo, 3% to 20% by mass of Cr, and 2% to 15% by mass of Mn, with the balance made up of incidental impurities and Fe, and the hard powder and the graphite powder contained in the powder mixture account for 5% to 60% by mass and 0.5% to 2.0% by mass of the total amount of the hard powder, the graphite powder, and the iron-based powder, respectively. The wear-resistant iron-based sintered alloy of the present invention is obtained by sintering the compact for producing a sintered alloy while diffusing C in the graphite powder of the compact for producing a sintered alloy in the hard particles.

According to the present invention, C in a graphite powder is not diffused in hard particles before sintering. Therefore, hard particles before sintering are softer than hard particles after sintering. Therefore, the density of a compact for producing a sintered alloy can be increased upon powder compacting to increase the area of contact between an iron-based powder that serves as a substrate raw material and hard particles. Accordingly, when a compact for producing a sintered alloy is sintered to obtain a sintered alloy, the degree of diffusion of iron in an iron-based substrate in hard particles increases, thereby making it possible to increase adhesiveness between the hard particles and the iron-based substrate so as to improve mechanical strength of a sintered alloy. In addition, as described below, C in a graphite powder tends to be diffused in hard particles upon sintering to form Mo carbide and Cr carbide with Mo and Cr in hard particles.

In the case of the above composition of hard particles, Mo in the composition of hard particles is an element that forms Mo carbide upon sintering so as to improve hardness and wear resistance of hard particles. Mo in the form of a solid solution in a high-temperature usage environment forms an Mo oxide film on the surface of a sintered alloy so that good solid wettability can be achieved.

If the content of Mo in hard particles is less than 10% by mass, solid wettability of the formed Mo oxide film is insufficient, which aggravates adhesion wear of a sintered alloy. In addition, the amount of generated Mo carbide decreases and therefore abrasive wear cannot be sufficiently suppressed. Meanwhile, if the content of Mo in hard particles exceeds 50% by mass, hardness of hard particles before powder compacting increases, which impairs formability upon powder compacting. As a result, mechanical strength of a sintered alloy decreases.

In the case of the above composition of hard particles, C in a graphite powder is diffused in hard particles so as to form Cr carbide with Cr in the composition of hard particles upon sintering. Therefore, Cr is an element effective against abrasive wear of a sintered alloy. Further, since Cr is more likely to be diffused in an iron-based substrate, compared with Mo, Cr is an element effective for improving adhesiveness between hard particles and an iron-based substrate by diffusing Cr in hard particles in an iron-based substrate upon sintering.

If the content of Cr in hard particles is less than 3% by mass, the amount of Cr diffused in an iron-based substrate decreases, which causes reduction of adhesiveness between hard particles and an iron-based substrate. Accordingly, mechanical strength of the obtained sintered alloy is reduced. Meanwhile, if the content of Cr in hard particles exceeds 20% by mass, hardness of hard particles before powder compacting increases, which impairs formability upon powder compacting. Accordingly, mechanical strength of the obtained sintered alloy is reduced.

In the case of the above composition of hard particles, Mn in the composition of hard particles is diffused from hard particles into an iron-based substrate of a sintered alloy upon sintering with good efficiency. Therefore, Mn is an element effective for improving adhesiveness between hard particles and an iron-based substrate.

If the content of Mn in hard particles is less than 2% by mass, the amount of Mn diffused in an iron-based substrate decreases, which causes reduction of adhesiveness between hard particles and an iron-based substrate. Accordingly, mechanical strength of the obtained sintered alloy decreases. Meanwhile, if the content of Mn in hard particles exceeds 15% by mass, Mn is excessively diffused in an iron-based substrate, which results in formation of an austenite structure in an iron-based substrate. Accordingly, mechanical strength of the obtained sintered alloy is reduced.

Further, according to the present invention, the hard powder and the graphite powder contained in the powder mixture account for 5% to 60% by mass and 0.5% to 2.0% by mass of the total amount of the hard powder, the graphite powder, and the iron-based powder.

Since the hard powder accounts for 5% to 60% by mass of the total amount of the hard powder, the graphite powder, and the iron-based powder, both mechanical strength and wear resistance of a sintered alloy can be improved. If the hard powder accounts for less than 5% by mass of the total amount of the hard powder, the graphite powder, and the iron-based powder, the content of hard particles is insufficient and therefore sufficient wear-resistant effects of hard particles cannot be obtained.

Meanwhile, if the hard powder accounts for more than 60% by mass of the total amount of the hard powder, the graphite powder, and the iron-based powder, the proportion of the iron-based substrate decreases. As a result, hard particles cannot be retained on the sintered alloy with sufficient adhesion force. Accordingly, hard particles might be detached from the sintered alloy, which would aggravate wear of the sintered alloy in an environment such as a contact/sliding environment in which wear is generated.

The graphite powder accounts for 0.5% to 2.0% by mass of the total amount of the hard powder, the graphite powder, and the iron-based powder. Therefore, solid solution diffusion of C from the graphite powder into hard particles can be achieved while preventing fusion of hard particles after sintering. Further, a pearlite structure can be securely formed in an iron-based substrate. Accordingly, both mechanical strength and wear resistance of a sintered alloy can be improved.

Here, if the graphite powder accounts for less than 0.5% by mass of the total amount of the hard powder, the graphite powder, and the iron-based powder, a ferrite structure tends to be formed to a greater extent in the iron-based substrate. As a result, strength of the iron-based substrate of the sintered alloy is reduced. Meanwhile, if the graphite powder accounts for more than 2.0% by mass of the total amount of the hard powder, the graphite powder, and the iron-based powder, fusion of hard particles partially takes place upon sintering, which results in reduction of hardness of hard particles. In addition, fused hard particles form a gas cavity and the gas cavity causes decreased mechanical strength and increased wear loss.

Preferably, C is not added to the hard particles. However, even if C is added to hard particles, the hard particles further contain 1.0% by mass or less of C in a preferable embodiment. In such embodiment, the content of C is limited to 1.0% by mass or less, thereby preventing generation of Mo carbide or Cr carbide. Accordingly, formability into a compact for producing a sintered alloy can be improved, thereby improving mechanical strength of a sintered alloy.

If the content of C added exceeds 1.0% by mass, C and Mo tend to form Mo carbide. As a result, hardness of hard particles increases, which inhibits performance of powder compacting and causes reduction of adhesiveness between hard particles and an iron-based substrate. Accordingly, mechanical strength of a sintered alloy might be reduced.

In a further preferable embodiment, the particle size of the hard particles is 44 to 105 μm. By setting the particle size in such range, it becomes possible to improve machinability of a wear-resistant iron-based sintered alloy after sintering.

If the particle size of hard particles is less than 44 μm, the particle size is too small, which might impair wear resistance of a wear-resistant iron-based sintered alloy. Meanwhile, if the particle size of hard particles exceeds 105 μm, the particle size is too large, which might cause reduction of machinability of a wear-resistant iron-based sintered alloy.

Further, it is preferable to form a valve sheet with a wear-resistant iron-based sintered alloy that is configured in the above manner. According to the present invention, even in a case in which adhesion wear and abrasive wear coexist in a valve sheet or the like in a high-temperature environment, adhesion wear and abrasive wear can be suppressed while securing mechanical strength of a valve sheet.

According to the present invention, it is possible to improve mechanical strength and wear resistance of a sintered alloy obtained by sintering a compact based on the premise that formability into a compact before sintering is improved.

BRIEF DESCRIPTION OF THE DRAWINGS

FIG. 4A shows a distribution of Cr, FIG. 4B shows a distribution of Mn, and FIG. 4C shows a distribution of C.

DETAILED DESCRIPTION OF THE EMBODIMENTS

Figure 1:
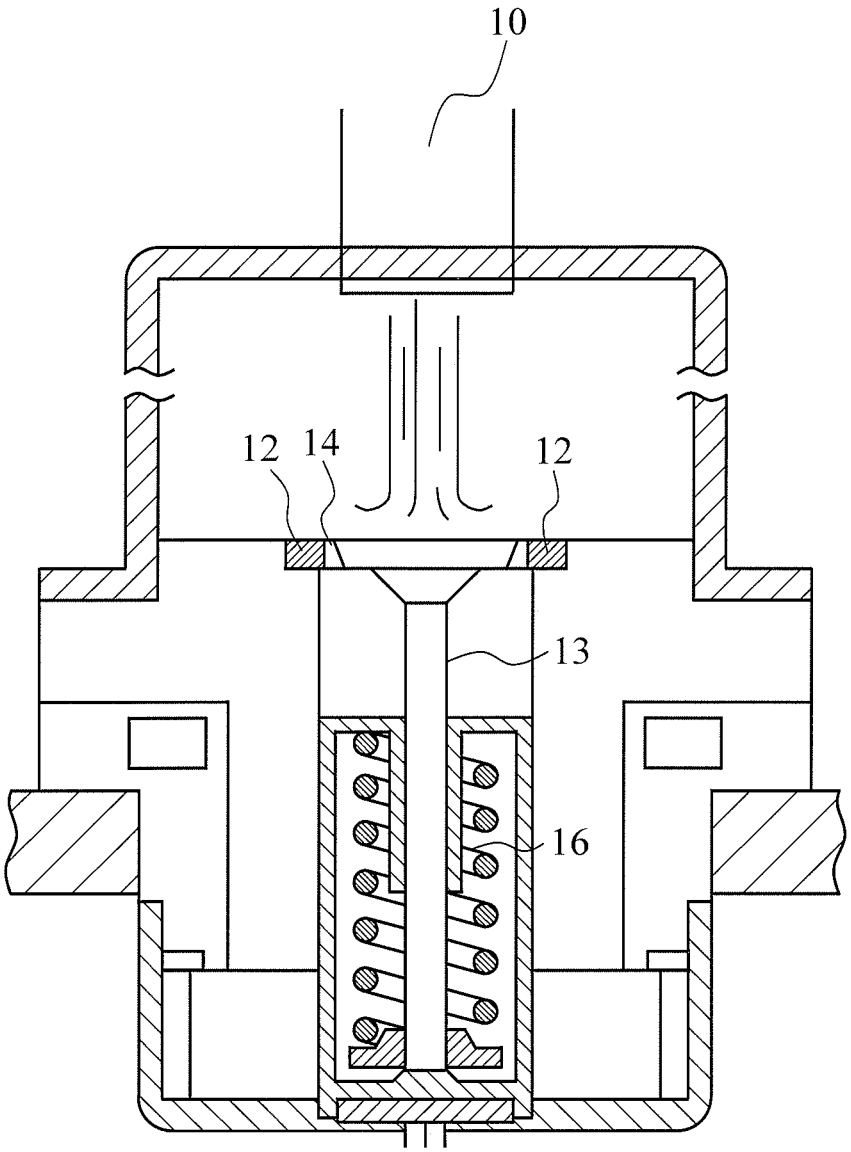
FIG. 1 schematically shows a conceptual diagram of the wear test used in Examples and Comparative Examples.

Embodiments of the present invention are described in detail below.

In the embodiments below, the compact for producing a sintered alloy is formed with a powder mixture containing a hard powder, a graphite powder, and an iron-based powder described below by powder compacting, and a wear-resistant iron-based sintered alloy is obtained by sintering the compact for producing a sintered alloy while diffusing C in a graphite powder in particles of a hard powder. A hard powder, a compact for producing a sintered alloy obtained by subjecting a powder mixture containing the hard powder to powder compacting, and a wear-resistant iron-based sintered alloy obtained by sintering the compact for producing a sintered alloy are described below. The term "powder" used herein refers to an aggregation of "particles." For example, a hard powder is an aggregation of hard particles.

1. Hard Powder

A hard powder is a powder including hard particles. Hard particles are mixed as a raw material in a sintered alloy and have higher hardness than that of an iron-based substrate of a sintered alloy. The hard particles contain 10% to 50% by mass of Mo, 3% to 20% by mass of Cr, and 2% to 15% by mass of Mn, with the balance made up of incidental impurities and Fe.

Such hard particles can be produced by atomization treatment including preparing a molten metal having the composition and the ratio described above and spraying the molten metal. Alternatively, the hard particles can be obtained by powderizing a concrete obtained by solidifying a molten metal through mechanical pulverization. Atomization treatment can be gas atomization treatment or water atomization treatment. However, in consideration of sintering performance, etc., gas atomization is preferable because rounded particles can be obtained.

The lower limit and the upper limit of the aforementioned composition of hard particles used herein can be appropriately changed depending on the reasons for limiting the composition described below and the degree of importance of characteristics of members to be used in view of hardness, solid wettability, adhesiveness, cost, etc. within the scope of the composition.

1-1. Mo: 10% to 50% by Mass

Mo in the composition of hard particles forms Mo carbide with C in a carbon powder upon sintering, thereby improving hardness and wear resistance of hard particles. In addition, a solid solution of Mo and Mo carbide in a high-temperature usage environment form an Mo oxide film and thus good solid wettability can be realized.

If the content of Mo is less than 10% by mass, the amount of generated Mo carbide decreases and the temperature at the start of oxidization of hard particles increases. This causes suppression of generation of Mo oxide in a high-temperature usage environment, which results in reduction of wear resistance of the obtained sintered metal. Meanwhile, if the content of Mo exceeds 50% by mass, adhesiveness between hard particles and an iron-based substrate decreases. The content of Mo is preferably 12% to 45% by mass.

1-2. Cr: 3% to 20% by Mass

Cr in the composition of hard particles is effective for compensating the lack of adhesion between hard particles and an iron-based substrate due to insufficient diffusion of Mo upon sintering. Further, Cr in the form of Cr carbide is effective for protecting Mo oxide film which is effective against adhesion wear but weak against abrasive wear when abrasive wear is generated, thereby protecting a sintered alloy from abrasive wear.

If the content of Cr in hard particles is less than 3% by mass, the amount of Cr diffused in an iron-based substrate decreases upon sintering in a high-temperature usage environment, which causes reduction of adhesiveness between hard particles and an iron-based substrate. This results in reduction of mechanical strength of the obtained sintered alloy. Meanwhile, if the content of Cr in hard particles exceeds 20% by mass, hardness of hard particles before powder compacting increases, which impairs formability upon powder compacting. This results in reduction of mechanical strength of a sintered alloy. The content of Cr is preferably 4% to 18% by mass.

1-3. Mn: 2% to 15% by Mass

Mn in the composition of hard particles is effective for improving adhesiveness between hard particles and an iron-based substrate because Mn in hard particles is diffused in an iron-based substrate of a sintered alloy upon sintering with good efficiency.

If the content of Mn in hard particles is less than 2% by mass, the amount of Mn diffused in an iron-based substrate decreases, which causes reduction of adhesiveness between hard particles and an iron-based substrate. This results in reduction of mechanical strength of the obtained sintered alloy. Meanwhile, if the content of Mn in hard particles exceeds 15% by mass, Mn is excessively diffused in an iron-based substrate. As a result, an austenite structure is formed in the iron-based substrate, which causes reduction of mechanical strength of the obtained sintered alloy. The content of Mn is preferably 3% to 12% by mass.

1-4. Other Elements

As an aside, C in the composition of hard particles binds to Mo and Cr to form Mo carbide and Cr carbide and therefore C is effective for improving hardness and wear resistance of hard particles. However, in embodiments of the present invention, the amount of C added is limited. Accordingly, upon powder compacting, the density of a compact and the area of contact between hard particles and an iron-based powder serving as a substrate raw material can be increased. As a result, diffusion of ion from an iron-based substrate into hard particles is increased. Accordingly, mechanical strength of a sintered alloy can be improved.

When C is added to hard particles, the content of C is preferably 1.0% by mass or less and more preferably 0.5% by mass or less. As a result of the addition of C, hardness of hard particles can be improved. In addition, generation of Mo carbide or Cr carbide can be suppressed by limiting the content of C to 1.0% by mass or less, thereby making it possible to increase formability into a compact. Accordingly, mechanical strength of a sintered alloy can be improved.

The particle size of hard particles can be appropriately selected depending on the usage and type of an iron-based sintered alloy. The particle size of hard particles is preferably 44 to 180 μm and more preferably 44 to 105 ρm. According to the experiments conducted by the present inventors described below, machinability of a wear-resistant iron-based sintered alloy after sintering can be improved when the particle size of hard particles is 44 to 105 μm.

If the particle size of hard particles is less than 44 μm, the particle size is too small, which might result in deterioration of wear resistance of a wear-resistant iron-based sintered alloy. On the other hand, if the particle size of hard particles exceeds 105 μm, the particle size is too large, which might cause reduction of machinability of a wear-resistant iron-based sintered alloy.

A graphite powder may be a powder including graphite particles of either natural graphite or artificial graphite or a mixture thereof as long as solid solution diffusion of C from the graphite powder into an iron-based substrate and a hard powder can be achieved upon sintering. The particle size of graphite particles that constitute a graphite powder is preferably 1 to 45 μm. Preferably, a graphite powder (Nippon Graphite Industries, ltd.: CPB-S) or the like can be used as graphite.

An iron-based powder that serves as a substrate includes iron-based particles containing Fe as a main component. An iron-based powder is preferably a pure iron powder but it may be a low-alloy steel powder as long as formability upon powder compacting is not impaired and diffusion of the above elements such as Cr and Mn in hard particles is not inhibited. As a low-alloy steel powder, a Fe—C-based powder can be adopted. For example, a low-alloy steel powder (100% by mass) that can be adopted contains 0.2% to 5% by mass of C with the balance made up of incidental impurities and Fe composition. In addition, such powder may be obtained by mechanical pulverization. It also may be a gas-atomized powder or a water-atomized powder. The particle size of iron-based particles that constitute an iron-based powder is preferably 150 μm or less.

2. Mixing Ratio of the Components of Powder Mixture

A powder mixture containing a hard powder, a graphite powder, and an iron-based powder is prepared. The hard powder and the graphite powder contained in the powder mixture account for 5% to 60% by mass and 0.5% to 2.0% by mass of the total amount of the hard powder, the graphite powder, and the iron-based powder, respectively. Preferably, the hard powder and the graphite powder contained in the powder mixture account for 5% to 55% by mass and 1.0% to 2.0% by mass of the total amount, respectively.

The powder mixture containing a hard powder, a graphite powder, and an iron-based powder may contain several percent by mass of a different powder based on the premise that mechanical strength and wear resistance of the obtained sintered alloy cannot be impaired. In this case, if the total amount of the hard powder, the graphite powder, and the iron-based powder accounts for 95% by mass of the amount of the powder mixture, sufficient effects of the powder mixture can be obtained. For example, the powder mixture may contain at least one agent (powder) for improving machinability selected from the group consisting of sulfide (e.g., MnS), oxide (e.g., $CaCO_3$), fluoride (e.g., CaF), nitride (e.g., BN), and oxy-sulfide.

Since the hard powder accounts for 5% to 60% by mass of the total amount of the hard powder, the graphite powder, and the iron-based powder, both mechanical strength and wear resistance of a sintered alloy can be improved. If the hard powder accounts for less than 5% by mass of the total amount, sufficient wear-resistant effects of hard particles cannot be obtained, as is apparent from the experiments conducted by the present inventors described below.

Meanwhile, if the hard powder accounts for more than 60% by mass of the total amount, it causes increased aggressiveness and prevents secured retention of hard particles. Specifically, the proportion of hard particles in an iron-based substrate decreases, which makes it difficult to retain hard particles on a sintered alloy with sufficient adhesion force. Accordingly, in an environment such as a contact/sliding environment in which wear is generated, hard particles can be detached from a sintered alloy, which might aggravate wear of the sintered alloy.

The graphite powder accounts for 0.5% to 2.0% by mass of the total amount of the hard powder, the graphite powder, and the iron-based powder. Therefore, solid solution diffusion of C from the graphite powder into hard particles can be achieved while preventing fusion of hard particles after sintering. Further, a pearlite structure can be securely formed in an iron-based substrate. Accordingly, both mechanical strength and wear resistance of a sintered alloy can be improved.

Here, if the graphite powder accounts for less than 0.5% by mass of the total amount, a ferrite structure tends to be formed to a greater extent in an iron-based substrate. As a result, strength of an iron-based substrate of a sintered alloy is reduced. Meanwhile, if the graphite powder accounts for more than 2.0% by mass of the total amount, fusion of hard particles partially takes place upon sintering, which results in reduction of hardness of hard particles. In addition, fused hard particles form a gas cavity and the gas cavity causes decreased mechanical strength and increased wear loss.

3. Method for Producing Wear-Resistant Iron-Based Sintered Alloy

The powder mixture obtained above is formed into a compact for producing a sintered alloy by powder compacting. As stated above, hard particles before sintering are softer than hard particles after sintering. Therefore, upon powder compacting, it is possible to increase the density of a compact for producing a sintered alloy and the area of contact between hard particles and an iron-based powder that serves as a substrate raw material.

A wear-resistant iron-based sintered alloy is produced by sintering a compact for producing a sintered alloy subjected to powder compacting while diffusing C in a graphite powder of the compact for producing a sintered alloy in hard particles that constitute a hard powder. At this time, diffusion of iron from the iron-based substrate into hard particles increases. In addition, carbon added to hard particles is limited. Accordingly, carbon in the graphite powder is likely to be diffused in hard particles to form Mo carbide and Cr carbide, thereby allowing the improvement of hardness of hard particles.

The sintering temperature that can be adopted is approximately 1050° C. to 1250° C., and in particular, approximately 1100° C. to 1150° C. The sintering time that can be adopted at the above sintering temperature is preferably 30 to 120 minutes and more preferably 45 to 90 minutes. A sintering atmosphere may be a non-oxidizing atmosphere such as an inert gas atmosphere. Examples of a non-oxidizing atmosphere include a nitrogen gas atmosphere, an argon gas atmosphere, and a vacuum atmosphere.

The substrate of the iron-based sintered alloy obtained by sintering preferably has a structure including a pearlite structure in order to secure hardness of the substrate. The structure including a pearlite structure may be a pearlite structure, a pearlite-austenite-based mixed structure, a pearlite-ferrite-based mixed structure, or a pearlite-cementite-based mixed structure. In order to secure wear resistance, it is preferable that the substrate contains a small amount of ferrite having low hardness. Hardness of the substrate is approximately Hv120 to 300, although it would vary depending on the composition. It can be adjusted in view of heat treatment conditions, the amount of a carbon powder to be added, etc. Note that the composition and hardness are not limited to the above as long as wear resistance such as adhesiveness between hard particles and a substrate is not reduced.

According to the above method, it is possible to obtain a sintered alloy that contains 0.5% to 30% by mass (and preferably 1.5% to 16.5% by mass) of Mo, 0.15% to 12% by mass (and preferably 0.5% to 7.2% by mass) of Cr, 0.1% to 9% by mass (and preferably 0.3% to 4.8% by mass) of Mn, and 2.0% by mass or less (and preferably 1.0% to 2.0% by mass) of C, with the balance made up of incidental impurities and Fe.

4. Applications of Wear-Resistant Iron-Based Sintered Alloy

A wear-resistant iron-based sintered alloy obtained by the production method described above has mechanical strength and wear resistance superior to those of conventional ones in a high-temperature usage environment. For example, it can be preferably used for a valve system (e.g., valve sheet or valve guide) of an internal combustion engine using, as a fuel, a compressed natural gas or a liquefied petroleum gas and a west gate valve of a turbocharger in a high-temperature usage environment.

For example, if a valve sheet of an exhaust valve of an internal combustion engine is formed with the wear-resistant iron-based sintered alloy, wear resistance of the valve sheet can be improved compared with conventional valve sheets, even in the coexistence of adhesion wear caused by contact between the valve sheet and the valve and abrasive wear caused by sliding of the valve sheet and the valve.

EXAMPLES

Specific examples of the present invention are described below with comparative examples.

Example 1

A wear-resistant iron-based sintered alloy was prepared in a manner described below.

Firstly, a hard powder was prepared so that the hard powder contained 30% by mass of Mo, 10% by mass of Cr, and 6% by mass of Mn, with the balance made up of incidental impurities and Fe. Specifically, an alloy powder was produced from a molten metal having the composition shown in Table 1 by gas atomization using an inert gas (nitrogen gas). Particles of the powder were classified within the range of 44 μm to 105 μm using a sieve designed in conformity with JIS standard Z8801. Thus, a powder of hard particles was obtained.

Next, a graphite powder (Nippon Graphite Industries, ltd.; CPB-S) and a reduced iron powder including pure iron (Höganäs Japan K. K.; model number: SC100.26) were prepared.

The hard powder, the graphite powder, and the iron powder were mixed at proportions of 40% by mass, 1.5% by mass, and 58.5% by mass, respectively, with the use of a V-shaped mixer for 30 minutes. Thus, a powder mixture was obtained.

Then, the obtained powder mixture is subjected to powder compacting at a pressure of 784 MPa using a forming die to form a ring-shaped test piece. Thus, a compact for producing a sintered alloy (powder compact) was formed. The powder compact was sintered at 1120° C. in an inert atmosphere (nitrogen gas atmosphere) for 60 minutes. Thus, a sintered alloy (valve sheet) of the test piece was formed.

Examples 2 to 8: Appropriate Proportions of the Components of Hard Particles A sintered alloy was prepared as in the case of Example 1. Examples 2 to 8 were intended to evaluate the appropriate proportions of the components of hard particles. As shown in Table 1, the mixing ratio of the components of a powder mixture in Examples 2 to 8 is the same as that in Example 1. Examples 2 to 8 differ from Example 1 in terms of the components of a hard powder. Specific differences are described below.

Examples 2 and 3 differ from Example 1 in that the contents of Mo in hard particles in Examples 2 and 3 were set to 12% by mass and 45% by mass, respectively.

Examples 4 and 5 differ from Example 1 in that the contents of Cr in hard particles in Examples 4 and 5 were set to 4% by mass and 18% by mass, respectively.

Examples 6 and 7 differ from Example 1 in that the contents of Mn in hard particles in Examples 6 and 7 were set to 3% by mass and 12% by mass, respectively.

Example 8 differs from Example 1 in that hard particles further contained C (0.4% by mass).

Example 9 to 21: Appropriate Mixing Ratio of the Components of Powder Mixture Sintered alloys were produced as in the case of Example 1. Examples 9 to 21 were intended to evaluate the appropriate mixing ratio of the components of a powder mixture. As shown in Table 1, the components of a hard powder in Examples 9 to 21 were the same as those in Example 1. Examples 9 to 21 differ from Example 1 in terms of the mixing ratio of the components of a powder mixture. Specific differences are described below.

Example 9 differs from Example 1 in that a powder mixture contained 5% by mass of a hard powder, 94.0% by mass of an iron powder, and 1.0% by mass of a graphite powder. Example 10 differs from Example 1 in that a powder mixture contained 5% by mass of a hard powder and 93.5% by mass of an iron powder.

Example 11 differs from Example 1 in that a powder mixture contained 10% by mass of a hard powder, 89.0% by mass of an iron powder, and 1.0% by mass of a graphite powder. Example 12 differs from Example 1 in that a powder mixture contained 10% by mass of a hard powder and 88.5% by mass of an iron powder.

Example 13 differs from Example 1 in that a powder mixture contained 15% by mass of a hard powder, 84.0% by mass of an iron powder, and 1.0% by mass of a graphite powder. Example 14 differs from Example 1 in that a powder mixture contained 15% by mass of a hard powder and 83.5% by mass of an iron powder.

Example 15 differs from Example 1 in that a powder mixture contained 30% by mass of a hard powder, 69.0% by mass of an iron powder, and 1.0% by mass of a graphite powder. Example 16 differs from Example 1 in that a powder mixture contained 30% by mass of a hard powder and 68.5% by mass of an iron powder. Example 17 differs from Example 1 in that a powder mixture contained 30% by mass of a hard powder, 68.0% by mass of an iron powder, and 2.0% by mass of a graphite powder.

Example 18 differs from Example 1 in that a powder mixture contained 59.0% by mass of an iron powder and 1.0% by mass of a graphite powder. Example 19 differs from Example 1 in that a powder mixture contained 58.0% by mass of an iron powder and 2.0% by mass of a graphite powder.

Example 20 differs from Example 1 in that a powder mixture contained 55% by mass of a hard powder, 44.0% by mass of an iron powder, and 1.0% by mass of a graphite powder. Example 21 differs from Example 1 in that a powder mixture contained 55% by mass of a hard powder and 43.5% by mass of an iron powder.

Comparative Examples 1 to 7: Comparative Examples of the Appropriate Proportions of the Components of Hard Particles Sintered alloys were produced as in the case of Example 1. Comparative Examples 1 to 7 were intended to evaluate the appropriate proportions of the components of hard particles in a powder mixture. Comparative Examples 1 to 7 were compared with Examples 1 to 8. As shown in Table 1, the mixing ratio of the components of a powder mixture in Comparative Examples 1 to 6 is the same as that in Example 1. Comparative Examples 1 to 6 differ from Example 1 in terms of the components of a hard powder. In addition, the mixing ratio of a powder mixture in Comparative Example 7 differs from that in Example 1. Specific differences are described below.

In Comparative Examples 1 and 2, the content of Mo in hard particles was not set in the range of the presentinvention (Mo: 10% to 50% by mass). Specifically, Comparative Example 1 differs from Example 1 in that the content of Mo was set to 5% by mass. Comparative Example 2 differs from Example 1 in that the content of Mo was set to 60% by mass.

In Comparative Examples 3 and 4, the content of Cr in hard particles was not set in the range of the present invention (Cr: 3% to 20% by mass). Specifically, Comparative Example 3 differs from Example 1 in that the content of Cr was set to 0% by mass (free of Cr) and the content of Mo was set to 40% by mass. Comparative Example 4 differs from Example 1 in that the content of Cr was set to 30% by mass. The hard powder of Comparative Example 4 corresponds to the hard powder disclosed in Patent Document 1 described above.

In Comparative Examples 5 and 6, the content of Mn in hard particles was not set in the range of the present invention (Mn: 2% to 15% by mass). Specifically, Comparative Example 5 differs from Example 1 in that the content of Mn was set to 0% by mass (free of Mn). Comparative Example 6 differs from Example 1 in that the content of Mn was set to 20% by mass.

In Comparative Example 7, the content of C in hard particles was not set in the range of the present invention (C: 1% by mass or less). Specifically, Comparative Example 7 differs from Example 1 in that the content of C was set to 1.5% by mass, and the mixing ratio of a powder mixture was set as shown in Table 1.

Comparative Examples 8 to 11: Comparative Examples of the Appropriate Mixing Ratio of the Components of Powder Mixture Sintered alloys were produced as in the case of Example 1. Comparative Examples 8 to 11 were intended to evaluate the appropriate mixing ratio of the components of a powder mixture. Comparative Examples 8 to 11 were compared with Examples 9 to 21. As shown in Table 1, the mixing ratio of the components of a hard powder in Comparative Examples 8 to 11 is the same as that in Example 1. Comparative Examples 8 to 11 differ from Example 1 in terms of the mixing ratio of a powder mixture. Specific differences are described below.

In Comparative Examples 8 and 9, the proportion of a hard powder was not set in the range of the present invention (hard powder: 5% to 60% by mass). Specifically, Comparative Example 8 differs from Example 1 in that a powder mixture contained 1% by mass of a hard powder, 98.0% by mass of an iron powder, and 1.0% by mass of a graphite powder. Comparative Example 9 differs from Example 1 in that a powder mixture contained 65% by mass of a hard powder and 33.5% by mass of an iron powder.

In Comparative Examples 10 and 11, the proportion of a graphite powder was not set in the range of the present invention (graphite powder: 0.5% to 2% by mass). Specifically, Comparative Example 10 differs from Example 1 in that a powder mixture contained 0% by mass of a graphite powder (free of a graphite powder) and 60.0% by mass of an iron powder. Comparative Example 11 differs from Example 1 in that a powder mixture contained 3.0% by mass of a graphite powder and 57.0% by mass of an iron powder.

Comparative Example 12

A sintered alloy was produced as in the case of Example 1. Comparative Example 12 differs from Example 1 in that hard particles containing 40% by mass of Mo, 9% by mass of Mn, 12% by mass of Ni, 25% by mass of Co, and 1.8% by mass of C, with the balance made up of incidental impurities and Fe, were used, and in that a powder mixture contained 0.6% by mass of a graphite powder and 59.4% by mass of an iron powder. The hard particles used herein correspond to the hard particles disclosed in JP 2001-181807 A.

Comparative Example 13

A sintered alloy was produced as in the case of Example 1. Comparative Example 13 differs from Example 1 in that hard particles containing 63% by mass of Mo and 1.1% by mass of Si, with the balance made up of incidental impurities and Fe, were used, and in that a powder mixture contained 0.6% by mass of a graphite powder and 59.4% by mass of an iron powder.

Comparative Example 14

A sintered alloy was produced as in the case of Example 1. Comparative Example 14 differs from Example 1 in that hard particles containing 28% by mass of Mo, 9% by mass of Cr, 60% by mass of Co, 0.1% by mass of C, and 2.2% by mass of Si, with the balance made up of incidental impurities and Fe, were used, and in that a powder mixture contained 0.6% by mass of a graphite powder and 59.4% by mass of an iron powder.

<Hardness Test>

The hardness of hard particles before sintering was determined using a micro Vickers hardness meter with a measuring load of 0.1 kgf for the hard particles obtained in Examples 1 to 21 and Comparative Examples 1 to 14. The results are shown in Table 1. In addition, the hardness of hard particles after sintering was determined for the hard particles obtained in Examples 1 and 15 to 19 and Comparative Examples 3, 13, and 14. The results are also shown in Table 1.

<Tensile Test>

Figure 2:
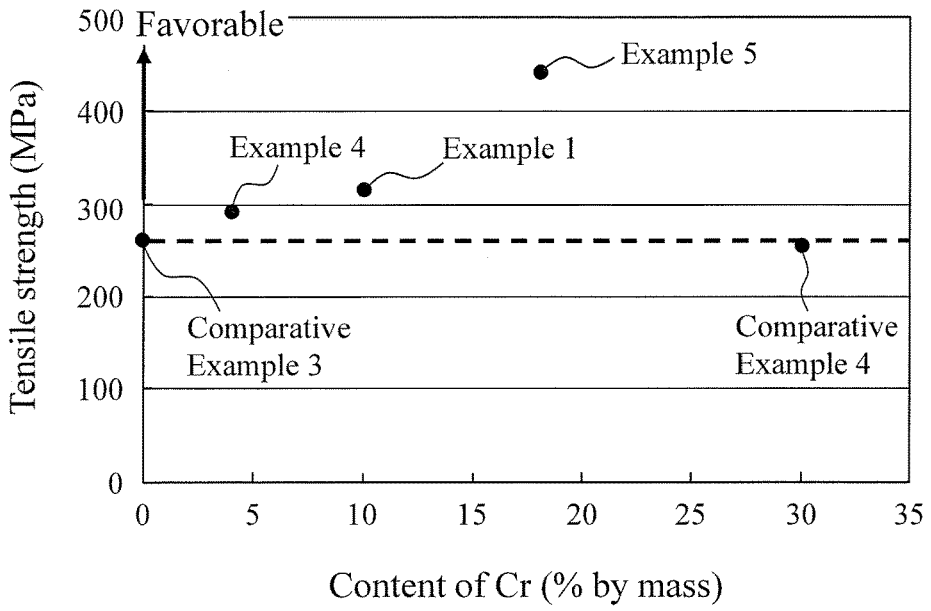
FIG. 2 is a graph showing the tensile strength results of the sintered alloys obtained in Examples 1, 4, and 5 and Comparative Examples 3 and 4.

Test pieces were prepared from the sintered alloys obtained in Examples 1 to 21 and Comparative Examples 1 to 14 and the tensile test (at 20° C.) was implemented to determine the tensile strength of each sintered alloy in accordance with JIS Z 2241. The results are shown in Table 1. FIG. 2 shows the tensile strength results of the sintered alloys obtained in Examples 1, 4, and 5 and Comparative Examples 3 and 4.

<Wear Test>

Figure 3:
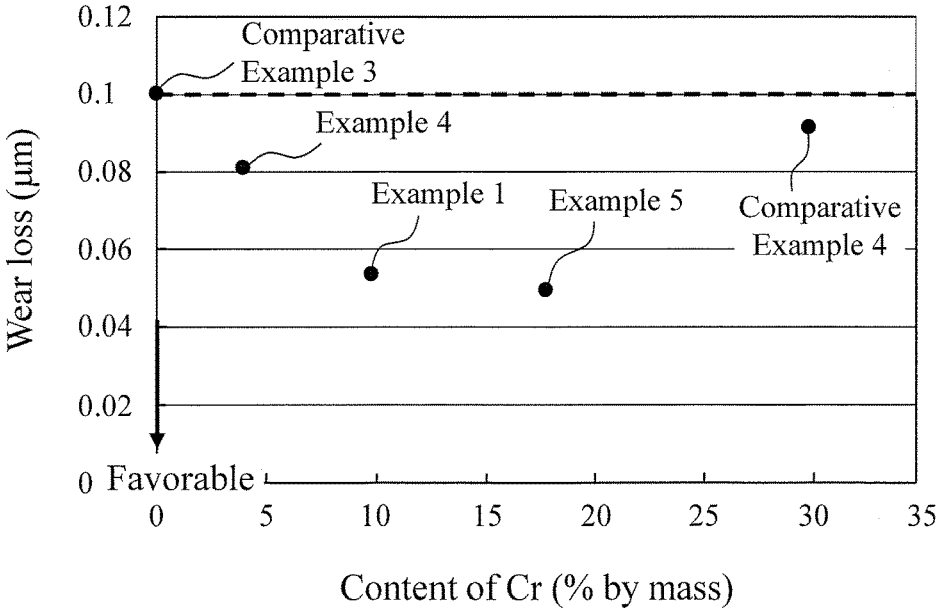
FIG. 3 is a graph showing the wear loss results for the sintered alloys obtained in Examples 1, 4, and 5 and Comparative Examples 3 and 4.

A wear test was performed using the tester shown in FIG. 1 to determine wear resistance for the sintered alloys obtained in Examples 1, 2, 4, 5, 9, 11, 13, 16, and 18 and Comparative Examples 1, 3, 4, 8, and 10 to 14 in order to evaluate wear resistance. In this wear test, as shown in FIG. 1, a propane gas burner 10 was used as a heat source, and a propane gas combustion atmosphere was created at a sliding face between a ring-shaped valve sheet 12 made of each sintered alloy produced in the manner described above and a valve face 14 of a valve 13. The valve face 14 was formed with SUH35 subjected to soft nitriding treatment. The wear test was performed in the following manner for eight hours. The temperature of the valve sheet 12 was controlled to 250° C. A load of 18 kgf was applied when a spring 16 allowed the valve sheet 12 and the valve face 14 to come into contact with each other. The valve sheet 12 and the valve face 14 were allowed to come into contact with each other at a frequency of 2000 times/minute. The results are shown in Table 1. In addition, FIG. 3 shows the results of wear loss for the sintered alloys obtained in Examples 1, 4, and 5 and Comparative Examples 3 and 4.

TABLE 1

| | Components of hard particles (% by mass) | | | | | | | Hardness of powder of hard particles before sintering | Mixing ratio of powders (% by mass) | | | | Test results | | Hardness of hard particles after sintering |
|---|---|---|---|---|---|---|---|---|---|---|---|---|---|---|---|
| | Mo | Cr | Mn | Ni | Co | C | Si | (HV) | Hard powder | Iron powder | Graphite powder | Components of sintered compact | Tensile strength (MPa) | Wear loss (μm) | (HV) |
| Example 1 | 30 | 10 | 6 | | | | | 398 | 40 | 58.5 | 1.5 | Fe—12Mo—4Cr—2.4Mn—1.5C | 316 | 0.054 | 943 |
| Example 2 | 12 | 10 | 6 | | | | | 386 | 40 | 58.5 | 1.5 | Fe—4.8Mo—4Cr—2.4Mn—1.5C | 406 | 0.088 | |
| Example 3 | 45 | 10 | 6 | | | | | 448 | 40 | 58.5 | 1.5 | Fe—18Mo—4Cr—2.4Mn—1.5C | 284 | | |
| Example 4 | 30 | 4 | 6 | | | | | 339 | 40 | 58.5 | 1.5 | Fe—12Mo—1.6Cr—2.4Mn—1.5C | 292 | 0.081 | |
| Example 5 | 30 | 18 | 6 | | | | | 516 | 40 | 58.5 | 1.5 | Fe—12Mo—7.2Cr—2.4Mn—1.5C | 442 | 0.050 | |
| Example 6 | 30 | 10 | 3 | | | | | 390 | 40 | 58.5 | 1.5 | Fe—12Mo—4Cr—1.2Mn—1.5C | 308 | | |
| Example 7 | 30 | 10 | 12 | | | | | 432 | 40 | 58.5 | 1.5 | Fe—12Mo—4Cr—4.8Mn—1.5C | 320 | | |
| Example 8 | 30 | 10 | 6 | | | 0.4 | | 560 | 40 | 58.5 | 1.5 | Fe—12Mo—4Cr—2.4Mn—1.7C | 303 | | |
| Example 9 | 30 | 10 | 6 | | | | | 398 | 5 | 94.0 | 1.0 | Fe—1.5Mo—0.5Cr—0.3Mn—1C | 432 | 0.046 | |
| Example 10 | 30 | 10 | 6 | | | | | 398 | 5 | 93.5 | 1.5 | Fe—1.5Mo—0.5Cr—0.3Mn—1.5C | 511 | | |
| Example 11 | 30 | 10 | 6 | | | | | 398 | 10 | 89.0 | 1.0 | Fe—3Mo—1Cr—0.6Mn—1C | 440 | 0.049 | |
| Example 12 | 30 | 10 | 6 | | | | | 398 | 10 | 88.5 | 1.5 | Fe—3Mo—1Cr—0.6Mn—1.5C | 433 | | |
| Example 13 | 30 | 10 | 6 | | | | | 398 | 15 | 84.0 | 1.0 | Fe—4.5Mo—1.5Cr—0.9Mn—1C | 408 | 0.046 | |
| Example 14 | 30 | 10 | 6 | | | | | 398 | 15 | 83.5 | 1.5 | Fe—4.5Mo—1.5Cr—0.9Mn—1.5C | 414 | | |
| Example 15 | 30 | 10 | 6 | | | | | 398 | 30 | 69.0 | 1.0 | Fe—9Mo—3Cr—1.8Mn—1C | 370 | | 924 |
| Example 16 | 30 | 10 | 6 | | | | | 398 | 30 | 68.5 | 1.5 | Fe—9Mo—3Cr—1.8Mn—1.5C | 398 | 0.036 | 923 |
| Example 17 | 30 | 10 | 6 | | | | | 398 | 30 | 68.0 | 2.0 | Fe—9Mo—3Cr—1.8Mn—2C | 288 | | 968 |
| Example 18 | 30 | 10 | 6 | | | | | 398 | 40 | 59.0 | 1.0 | Fe—12Mo—4Cr—2.4Mn—1C | 321 | 0.055 | 908 |
| Example 19 | 30 | 10 | 6 | | | | | 398 | 40 | 58.0 | 2.0 | Fe—12Mo—4Cr—2.4Mn—2C | 296 | | 956 |
| Example 20 | 30 | 10 | 6 | | | | | 398 | 55 | 44.0 | 1.0 | Fe—16.5Mo—5.5Cr—3.3Mn—1C | 266 | | |
| Example 21 | 30 | 10 | 6 | | | | | 398 | 55 | 43.5 | 1.5 | Fe—16.5Mo—5.5Cr—3.3Mn—1.5C | 278 | | |
| Comparative Example 1 | 5 | 10 | 6 | | | | | 298 | 40 | 58.5 | 1.5 | Fe—2Mo—4Cr—2.4Mn—1.5C | 482 | 0.150 | |
| Comparative Example 2 | 60 | 10 | 6 | | | | | 898 | 40 | 58.5 | 1.5 | Fe—24Mo—4Cr—2.4Mn—1.5C | 109 | | |
| Comparative Example 3 | 40 | | 6 | | | | | 260 | 40 | 58.5 | 1.5 | Fe—16Mo—2.4Mn—1.5C | 262 | 0.100 | 880 |
| Comparative Example 4 | 30 | 30 | 6 | | | | | 849 | 40 | 58.5 | 1.5 | Fe—12Mo—12Cr—2.4Mn—1.5C | 258 | 0.092 | |
| Comparative Example 5 | 30 | 10 | | | | | | 373 | 40 | 58.5 | 1.5 | Fe—12Mo—4Cr—1.5C | 148 | | |
| Comparative Example 6 | 30 | 10 | 20 | | | | | 485 | 40 | 58.5 | 1.5 | Fe—12Mo—4Cr—8Mn—1.5C | 190 | | |
| Comparative Example 7 | 30 | 10 | 6 | | | 1.5 | | 1200 | 40 | 59.4 | 0.6 | Fe—12Mo—4Cr—2.4Mn—1.2C | 145 | | |

TABLE 1-continued

| | Components of hard particles (% by mass) | | | | | | | Hardness of powder of hard particles before sintering | Mixing ratio of powders (% by mass) | | | | Test results | | Hardness of hard particles after sintering |
|---|---|---|---|---|---|---|---|---|---|---|---|---|---|---|---|
| | Mo | Cr | Mn | Ni | Co | C | Si | (HV) | Hard powder | Iron powder | Graphite powder | Components of sintered compact | Tensile strength (MPa) | Wear loss (μm) | (HV) |
| Comparative Example 8 | 30 | 10 | 6 | | | | | 398 | 1 | 98.0 | 1.0 | Fe—0.3Mo—0.1Cr—0.06Mn—1C | 500 | 0.189 | |
| Comparative Example 9 | 30 | 10 | 6 | | | | | 398 | 65 | 33.5 | 1.5 | Fe—19.5Mo—6.5Cr—3.9Mn—1.5C | 112 | | |
| Comparative Example 10 | 30 | 10 | 6 | | | | | 398 | 40 | 60.0 | 0.0 | Fe—12Mo—4Cr—2.4Mn | 151 | 0.105 | |
| Comparative Example 11 | 30 | 10 | 6 | | | | | 398 | 40 | 57.0 | 3.0 | Fe—12Mo—4Cr—2.4Mn—3C | 217 | 0.110 | |
| Comparative Example 12 | 40 | | 9 | 12 | 25 | 1.8 | | 790 | 40 | 59.4 | 0.6 | Fe—16Mo—3.6Mn—4.8Ni—10Co—1.3C | 260 | 0.100 | |
| Comparative Example 13 | 63 | | | | | | 1.1 | 1000 | 40 | 59.4 | 0.6 | Fe—25.2Mo—0.44Si—0.6C | 85 | 0.300 | 1050 |
| Comparative Example 14 | 28 | 9 | | | 60 | 0.1 | 2.2 | 850 | 40 | 59.4 | 0.6 | Fe—11.2Mo—3.6Cr—24Co—0.88Si—0.6C | 160 | 0.180 | 850 |

<Element Analysis>

Figure 4A:
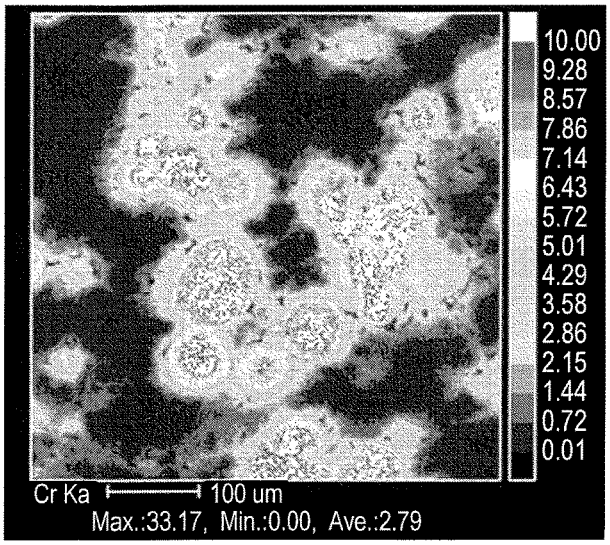
FIGS. 4A, 4B, and 4C show the results of electron probe micro analysis (EPMA) of the sintered alloy obtained in Example 1.
Figure 4B:
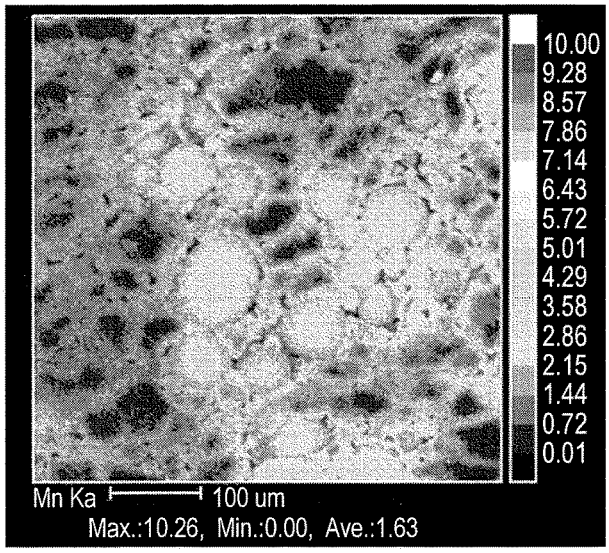
Figure 4C:
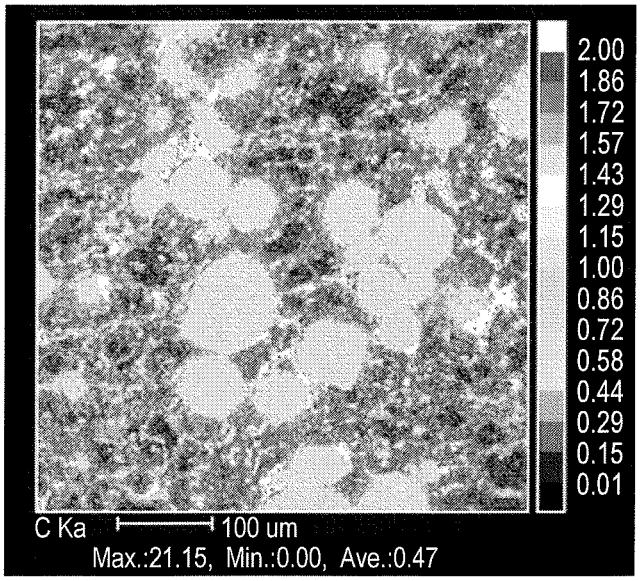

The sintered alloy obtained in Example 1 was subjected to elemental analysis by EPMA. The results are shown in FIGS. 4A, 4B and 4C. FIG. 4A shows a distribution of Cr, FIG. 4B shows a distribution of Mn, and FIG. 4C shows a distribution of C.

(Result 1: Content of Mo in Hard Particles)

In a case in which the content of Mo in hard particles was 5% by mass (less than 10% by mass) as in Comparative Example 1, the wear loss of the sintered alloy increased, compared with Examples 1 to 21. It is considered that in the case of Comparative Example 1, the amount of generated Mo carbide decreased while the temperature at the start of oxidization of hard particles increased, which caused suppression of generation of Mo oxide in a high-temperature usage environment and resulted in reduction of wear resistance of the obtained sintered metal.

Meanwhile, in a case in which the content of Mo in hard particles was 60% by mass (more than 50% by mass) as in Comparative Example 2, the tensile strength of the sintered alloy decreased, compared with Examples 1 to 21. It is considered that the hardness of hard particles before sintering was greater than that in Examples 1 to 21 in the case of Comparative Example 2, which caused impairment of formability upon powder compacting and resulted in reduction of the mechanical strength of the sintered alloy. Based on the above, the content of Mo in hard particles is preferably 10% to 50% by mass and more preferably 12% to 45% by mass from the results in Examples 2 and 3.

(Result 2: Content of Cr in Hard Particles)

In a case in which the content of Cr in hard particles was 0% by mass (less than 3% by mass) as in Comparative Example 3, the tensile strength of the sintered alloy decreased while the wear loss thereof increased, compared with Examples 1 to 21. It is considered that Cr contained in hard particles was diffused in a substrate upon sintering in Examples 1 to 21 (see, e.g., FIG. 4A), while on the other hand, Cr was not diffused in an iron-based substrate upon sintering in Comparative Example 3, which resulted in reduction of adhesiveness between hard particles and an iron-based substrate and caused reduction of the tensile strength of the obtained sintered alloy (see, e.g., FIG. 2). Further, it is considered that as in the cases of Examples 1 to 21, since diffusion of Cr prevented generation of CrC in hard particles in Comparative Example 3, hardness of hard particles after sintering decreased, compared with Example 1 and other examples, and the wear loss of the sintered alloy increased, compared with Examples 1 to 21 (see, e.g., FIG. 3).

Meanwhile, in a case in which the content of Cr in hard particles was 30% by mass (more than 20% by mass) as in Comparative Example 4, tensile strength of the sintered alloy decreased, compared with Examples 1 to 21. It is considered that hardness of hard particles before sintering in Comparative Example 4 was greater than that in Examples 1 to 21, which impaired formability upon powder compacting and caused reduction of the tensile strength of the sintered alloy (see, e.g., FIG. 2). Based on the above, the content of Cr in hard particles is preferably 3% to 20% by mass and more preferably 4% to 18% by mass from the results in Examples 4 and 5.

(Result 3: Content of Mn in Hard Particles)

In a case in which the content of Mn in hard particles was 0% by mass (less than 2% by mass) as in Comparative Example 5, the tensile strength of the sintered alloy was smaller than that in Examples 1 to 21. It is considered that Mn contained in hard particles was diffused in a substrate upon sintering (see, e.g., FIG. 4B) in Example 1 to 21, while on the other hand, Mn was not diffused in an iron-based substrate upon sintering in Comparative Example 3, which caused reduction of adhesiveness between hard particles and the iron-based substrate and reduction of the tensile strength of the obtained sintered alloy.

Also, in a case in which the content of Mn in hard particles was 20% by mass (more than 15% by mass) as in Comparative Example 6, the tensile strength of the sintered alloy was smaller than that in Examples 1 to 21. It is considered that in the case of Comparative Example 6, Mn was excessively diffused in an iron-based substrate, which caused formation of an austenite structure in the iron-based substrate and reduction of the tensile strength of the sintered alloy. Based on the above, the content of Mn in hard particles is preferably 2% to 15% by mass and more preferably 3% to 12% by mass from the results in Examples 6 and 7.

In addition, hard particles contained Si instead of Mn in Comparative Examples 13 and 14. In this case, the tensile strength of the sintered alloy was lower than that in Examples 1 to 21. It is considered that hardness of hard particles before sintering increased due to diffusion of silicide, compared with that in Examples 1 to 21, which resulted in impairment of formability upon powder compacting.

(Result 4: Content of C in Hard Particles)

In a case in which the content of C in hard particles was 1.5% by mass (more than 1.0% by mass) as in Comparative Example 7, the tensile strength of the sintered alloy was smaller than that in Examples 1 to 21. It is considered that hardness of hard particles before sintering in Comparative Example 7 was greater than that in Examples 1 to 21, which caused impairment of formability upon powder compacting and reduction of the tensile strength of the sintered alloy.

Meanwhile, it is considered that in the cases of Example 1 to 21, the content of C in hard particles was limited, and C in a graphite powder was diffused upon sintering (see, e.g., FIG. 4C), which caused increased hardness of hard particles after sintering. Based on the above, the content of C in hard particles is controlled to preferably 1.0% by mass or less and more preferably 0.4% by mass or less from the results in Example 8.

(Result 5: Proportion of a Hard Powder)

In a case in which the proportion of a hard powder in a mixture was 1% by mass (less than 5% by mass) as in Comparative Example 8, formability increased and thus the tensile strength of the sintered alloy increased, compared with Examples 1 to 21. However, it is considered that sufficient wear-resistant effects could not be obtained because of the small proportion of a hard powder.

Meanwhile, in a case in which the proportion of a hard powder in a powder mixture was 65% by mass (more than 60% by mass) as in Comparative Example 9, the tensile strength of a sintered alloy was lower than that in Example 1 to 21. It is considered that the proportion of hard particles diffused in an iron-based substrate decreased in the case of Comparative Example 9, which made it impossible to retain hard particles on a sintered alloy with sufficient adhesion force. Based on the above, the proportion of a hard powder in a powder mixture is preferably 5% to 60% by mass and more preferably 5% to 55% by mass.

(Result 6: Proportion of a Graphite Powder)

In a case in which the proportion of a hard powder in a powder mixture was 0% by mass (when the proportion of a graphite powder was 0.5% by mass or less) as in Comparative Example 10, the tensile strength of a sintered alloy decreased while wear loss increased, compared with Example 1 to 21. It is considered that in the case of Comparative Example 10, a ferrite structure tended to be formed to a greater extent in an iron-based substrate, which caused reduction of the strength of an iron-based substrate of a sintered alloy.

Meanwhile, in a case in which the proportion of a hard powder contained in a powder mixture was 3.0% by mass (when the proportion of a graphite powder exceeded 2.0% by mass) as in Comparative Example 11, the tensile strength of a sintered alloy decreased while wear loss increased, compared with Examples 1 to 21. It is considered that in the case of Comparative Example 11, fusion of hard particles partially took place and thus hardness of hard particles decreased upon sintering, and fused hard particles formed a gas cavity fusion, which caused mechanical strength to decrease and wear loss to increase. Based on the above, the proportion of a hard powder in a powder mixture is preferably 0.5% to 2.0% by mass and more preferably 1.0% to 2.0% by mass.

Examples 22 and 23

A sintered alloy similar to that produced in Example 9 was produced under the conditions listed in Table 2 in Example 22. A sintered alloy similar to that produced in Example 11 was produced under the conditions listed in Table 2 in Example 23.

Comparative Examples 15 and 16

A sintered alloy was produced in Comparative Example 15 as in Example 22. Comparative Example 15 differs from Example 22 in that hard particles had particle sizes of 44 to 180 μm in Comparative Example 15 while Example 22 hard particles had particle sizes of 44 to 105 μm.

A sintered alloy was produced in Comparative Example 16 as in the case of Example 23. Comparative Example 16 differs from Example 23 in that hard particles had particle sizes of 44 to 180 μm in Comparative Example 16 while hard particles had particle sizes of 44 to 105 μm in Example 23. Note that although the sintered alloys produced in Comparative Examples 15 and 16 fall within the scope of the present invention, they were compared as comparative examples with those produced in Examples 22 and 23 for the sake of convenience.

<Cutting Test>

The sintered alloys obtained in Examples 22 and 23 and Comparative Examples 15 and 16 were subjected to a cutting tool wear test. Specifically, cutting corresponding to 300 paths (1 path corresponds to a length of a valve sheet to be cut at a time) was performed on test pieces obtained in Example 1 and Comparative Example 1 using a cutting tool (superhard material) under the following conditions: feed speed: 0.3 mm; and radial feed: 0.08 mm/rev. Then, the maximum wear depth of a flank face of a cutting tool was measured as the wear loss of a cutting tool using an optical microscope. The results are shown in Table 2.

TABLE 2

| | Components of hard particles (% by mass) | | | | | | | Hardness of powder of hard particles before sintering | Mixing ratio of powders used as raw materials for sintering (% by mass) | | | | Test results | |
|---|---|---|---|---|---|---|---|---|---|---|---|---|---|---|
| | Mo | Cr | Mn | Ni | Co | C | Si | (HV) | Hard particles | Iron powder | Graphite | Components of sintered compact | Particle size of hard particles μm | Wear loss (μm) |
| Example 22 | 30 | 10 | 6 | | | | | 398 | 5 | 94.0 | 1.0 | Fe—1.5Mo—0.5Cr—0.3Mn—1C | 44-105 | 0.053 |
| Example 23 | 30 | 10 | 6 | | | | | 398 | 10 | 89.0 | 1.0 | Fe—3Mo—1Cr—0.6Mn—1C | 44-105 | 0.057 |
| Example 15 | 30 | 10 | 6 | | | | | 398 | 5 | 94.0 | 1.0 | Fe—1.5Mo—0.5Cr—0.3Mn—1C | 44-180 | 0.098 |
| Example 16 | 30 | 10 | 6 | | | | | 398 | 10 | 89.0 | 1.0 | Fe—3Mo—1Cr—0.6Mn—1C | 44-180 | 0.111 |

(Result 7: Optimum Particle Size of Hard Particles)

As shown in Table 2, the wear loss of a cutting tool used for cutting a sintered alloy in Examples 22 and 23 was smaller than that in Comparative Examples 15 and 16. It is considered that the hard particles of Comparative Examples 15 and 16 included hard particles having particle sizes of more than 105 μm and such excessive particle sizes caused reduction of machinability of a sintered alloy. Therefore, it is preferable for hard particles to have particle sizes of 105 μm. In addition, if hard particles have particle sizes of less than 44 μm, wear resistance of an iron-based sintered alloy might be impaired because the particles sizes are excessively small. It is therefore preferable for hard particles to have particle sizes of 44 μm or more.

Embodiments of the present invention are described in detail above. The present invention, however, is not limited to the embodiments and therefore various changes and modifications may be made in the invention without departing from the spirit of the invention specified in the attached claims.

What is claimed is:

1. A method for producing a wear-resistant iron-based sintered alloy, which comprises the steps of:

forming a compact for producing a sintered alloy from a powder mixture containing a hard powder, a graphite powder, and an iron-based powder by powder compacting; and sintering the compact for producing a sintered alloy while diffusing C in the graphite powder of the compact for producing a sintered alloy in hard particles that constitute the hard powder, wherein the hard particles contain 10% to 50% by mass of Mo, 3% to 20% by mass of Cr, and 2% to 15% by mass of Mn, with the balance made up of incidental impurities and Fe, the hard powder and the graphite powder contained in the powder mixture account for 5% to 60% by mass and 0.5% to 2.0% by mass of the total amount of the hard powder, the graphite powder, and the iron-based powder, respectively, and the hard particles contain 0% by mass of Ni, and 0% by mass Co.

2. The method for producing a wear-resistant iron-based sintered alloy according to claim 1, wherein the hard particles further contain 1.0% by mass or less of C.

3. The method for producing a wear-resistant iron-based sintered alloy according to claim 1, wherein the hard particles have particle sizes of 44 to 105 μm.

* * * * *